US008534883B2

(12) United States Patent
Tomasi et al.

(10) Patent No.: US 8,534,883 B2
(45) Date of Patent: Sep. 17, 2013

(54) LIGHT FIXTURE

(75) Inventors: Gorki Tomasi, Villingen-Schwenningen (DE); Marcus Eberhardt, Aixheim (DE)

(73) Assignee: Herbert Waldmann GmbH & Co. KG, Villingen-Schwenningen (DE)

( * ) Notice: Subject to any disclaimer, the term of this patent is extended or adjusted under 35 U.S.C. 154(b) by 105 days.

(21) Appl. No.: 13/145,383

(22) PCT Filed: Mar. 23, 2010

(86) PCT No.: PCT/EP2010/001812

§ 371 (c)(1),
(2), (4) Date: Sep. 23, 2011

(87) PCT Pub. No.: WO2010/108656

PCT Pub. Date: Sep. 30, 2010

(65) Prior Publication Data

US 2012/0002428 A1 Jan. 5, 2012

(30) Foreign Application Priority Data

Mar. 27, 2009 (DE) ..... 10 2209 014 706

(51) Int. Cl.
*F21S 6/00* (2006.01)

(52) U.S. Cl.
USPC ..... 362/382; 362/410; 362/413; 362/414

(58) Field of Classification Search
USPC ..... 362/382, 410, 413, 414
See application file for complete search history.

(56) References Cited

U.S. PATENT DOCUMENTS

| | | | | |
|---|---|---|---|---|
| 4,581,684 | A | 4/1986 | Mazzucco | |
| 5,641,223 | A * | 6/1997 | Rustebakke | 362/122 |
| 5,871,274 | A * | 2/1999 | Lee et al. | 362/413 |
| 6,926,428 | B1 * | 8/2005 | Lee | 362/431 |
| 7,484,858 | B2 | 2/2009 | Deighton et al. | |
| 2003/0103357 | A1 | 6/2003 | Drake et al. | |
| 2008/0239715 | A1 | 10/2008 | Deighton et al. | |

OTHER PUBLICATIONS

German Examination Report for Appln. Serial No. DE 10 2009 014 706.3 mailed Nov. 24, 2009, 4 pages (German); 2 pages (English).
International Search Report for PCT/EP2010/001812 mailed Jun. 17, 2010, 2 pages—German, 2 pages—English translation.

* cited by examiner

*Primary Examiner* — Anabel Ton
(74) *Attorney, Agent, or Firm* — Lackenbach Siegel, LLP; Andrew F. Young, Esq.

(57) ABSTRACT

The invention relates to a lamp, essentially containing a lamp head, an upright tube, and a stand. These three elements can be connected to each other in a releasable and latchable manner based upon an operable construction. In the assembled state, the three elements form a table lamp or a floor lamp based on dimensions. The lamp head can be removed and thus can be used as a mobile hand lamp. After disassembly, all parts can be accommodated in the stand, which forms a transport case.

10 Claims, 6 Drawing Sheets

LIGHT FIXTURE

CROSS REFERENCE TO RELATED APPLICATIONS

This application claims priority from PCT Patent Application Ser. No. PCT/EP2010/001812, filed Mar. 23, 2010, the entire contents of which is herein incorporated fully by reference, which in turn claims priority form German Patent Application Serial No. 10 2009 014 706.3 filed Mar. 27, 2009.

FIGURE FOR PUBLICATION

FIG. 1

BACKGROUND OF THE INVENTION

1. Field of the Invention

The present invention relates to a lamp. More particularly, the present invention relates to lamp having components that can be connected to each other in a releasable and latchable manner and can be stored during transport.

2. Description of the Related Art

The related art involves lamps as can be noted in U.S. Pat. No. 7,484,858, the entire contents of which are incorporated herein by reference. This particular related art notes the difficulties of the art.

Accordingly, there is a need for an improved lamp device that enables ready storage and transport while securing reliable and sturdy lamp use in a variety of forms.

ASPECTS AND SUMMARY OF THE INVENTION

The proposed invention provides a lamp, essentially containing a lamp head, an upright tube, and a stand. These three elements can be connected to each other in a releasable and latchable manner based upon an operable construction. In the assembled state, the three elements form a table lamp or a floor lamp based on dimensions. The lamp head can be removed and thus can be used as a mobile hand lamp. After disassembly, all parts can be accommodated in the stand, which forms a transport case.

According to one aspect of the proposed invention that the lamp consists substantially of a lamp head, a stand foot and an upright tube connecting the lamp head and the stand foot. These elements can be connected to each other in a releasable and latchable manner. The stand foot is designed here as a case and serves during transport and storage to receive the lamp head with the associated mains cable and the upright tube.

It is another aspect of the present invention that it should improve the support of the lamp elements, in particular of the lamp head, inside the case in such a manner that on the one hand the lamp elements, in particular the lamp head, can be rapidly removed without problems and on the other hand the lamp elements are securely fixed inside the case even during transport, whereby the entire case should be constructed as compactly as possible.

The invention addresses the noted concerns by providing compartments for receiving the disassembled stand foot and the mains cable are provided on both sides of the lamp head inserted into the stand foot, which compartments can be closed with cover flaps attached in an articulated manner to the stand foot.

In another aspect of the present invention, the lamp head can be designed as a mobile hand lamp, whereby it comprises a handle on its top.

In another aspect of the present invention, constructive details make possible a simple assembly or disassembly of this lamp and its reliable transport.

It is another aspect of the present invention that such a mobile workplace lamp can preferably be used for industrial and scientific purposes in the testing of materials, e.g., the surface testing of lacquered parts or in archaeology, whereby the lamp head can be provided, depending on the intended use, with special lamps, e.g., lamps for generating UV- or IR light.

The above, and other aspects, features and advantages of the present invention will become apparent from the following description read in conduction with the accompanying drawings, in which like reference numerals designate the same elements.

DETAILED DESCRIPTION OF THE PREFERRED EMBODIMENTS

Figure 1:
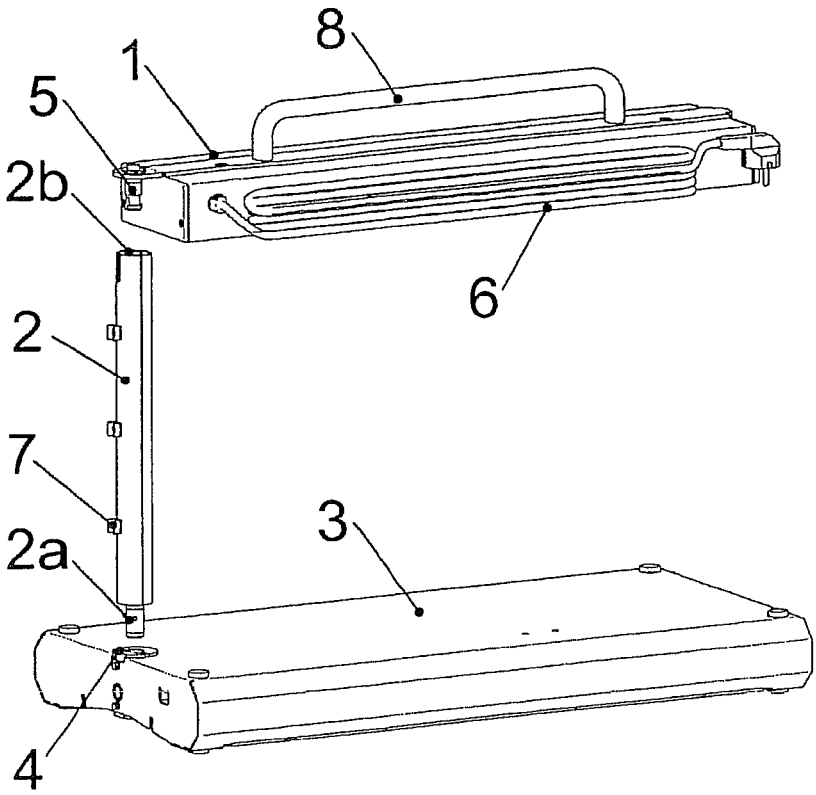
FIG. 1 shows a lamp in accordance with the invention in an exploded view.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Figure 6:
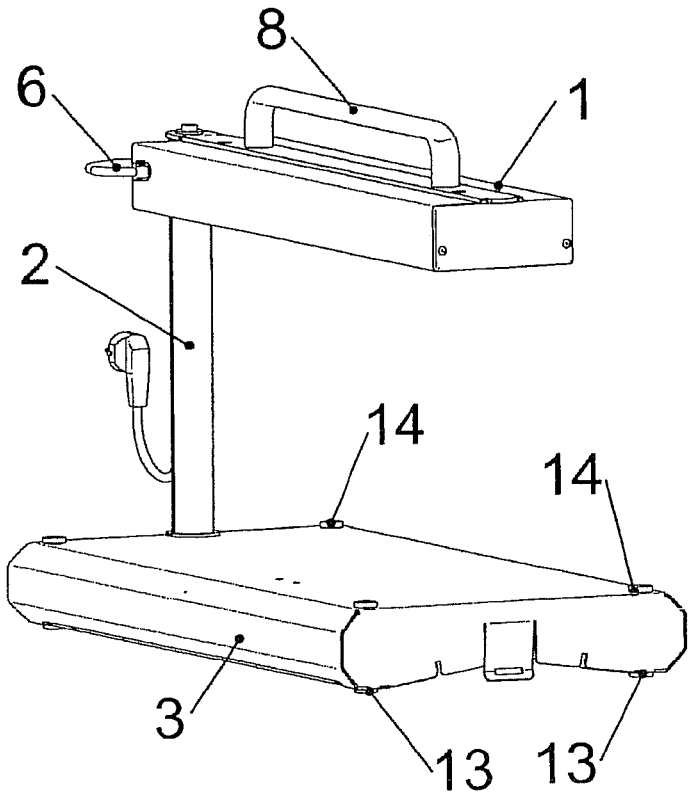
FIG. 6 shows the lamp according to FIG. 1 in the completely assembled state.

Referring now to FIGS. 1 and 6, the mobile workplace lamp in accordance with the invention includes a lamp head 1 that forms the actual lamp head and is releasably fastenable by an upright tube 2 to stand foot 3 set on the base. Upright tube 2 can be set with a pin 2*a* into a sleeve 4 provided on stand foot 3 and releasably locked in the manner of a bayonet catch in the correct position. In a similar manner lamp head 1 is provided on its side with a pin 5 that can be set into a pin receptacle located on the upper end of upright tube 2 and that can also be releasably locked in it. The mains cable 6 shown in FIG. 1 adjacent to lamp head 1 can be fixed on stand 2 in the assembled state shown in FIG. 6 with the aid of cable holders 7 constructed as clips.

Additionally referring FIG. 2, stand foot 3 is shown serving as transport case and viewed from below in contrast to the view according to FIG. 1, into which lamp head 1 with its mains cable 6 and upright tube 2 are inserted, whereby cover flaps 9 attached in an articulated manner cover the inner space of stand foot 3, which now foul's a transport case. Lamp head 1 is inserted here in such a manner into the inside of stand foot 3 that the handle 8 provided on the top of lamp head 1 projects upward and thus serves for a simple transport.

Figure 3:
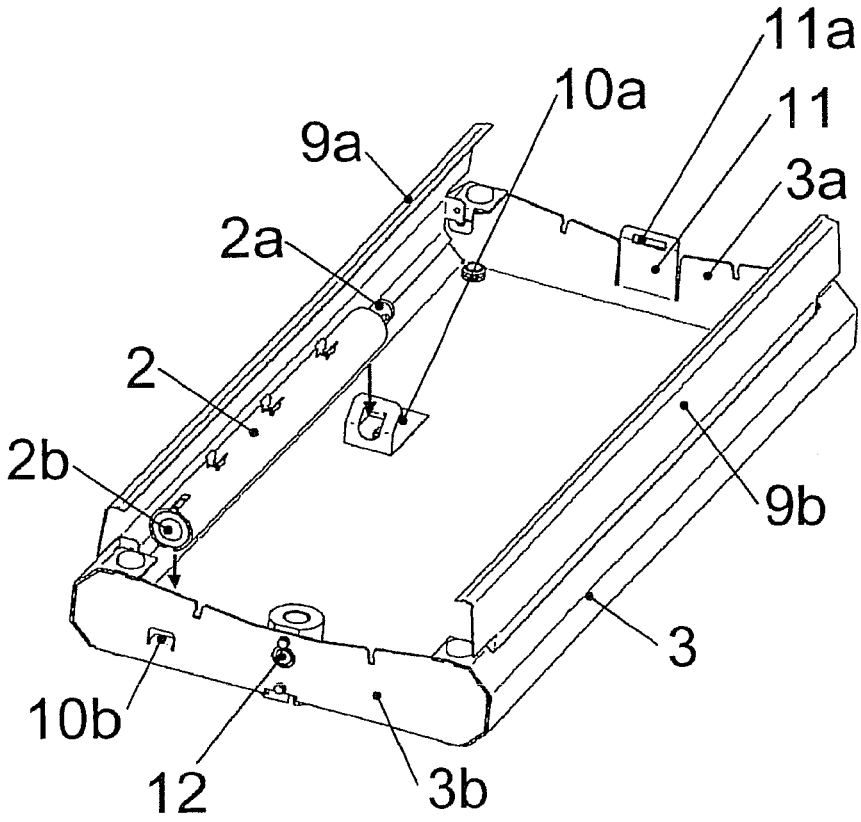
FIG. 3 shows the stand foot according to FIG. 2 in the open state with the upright tube to be inserted.
Figure 4:
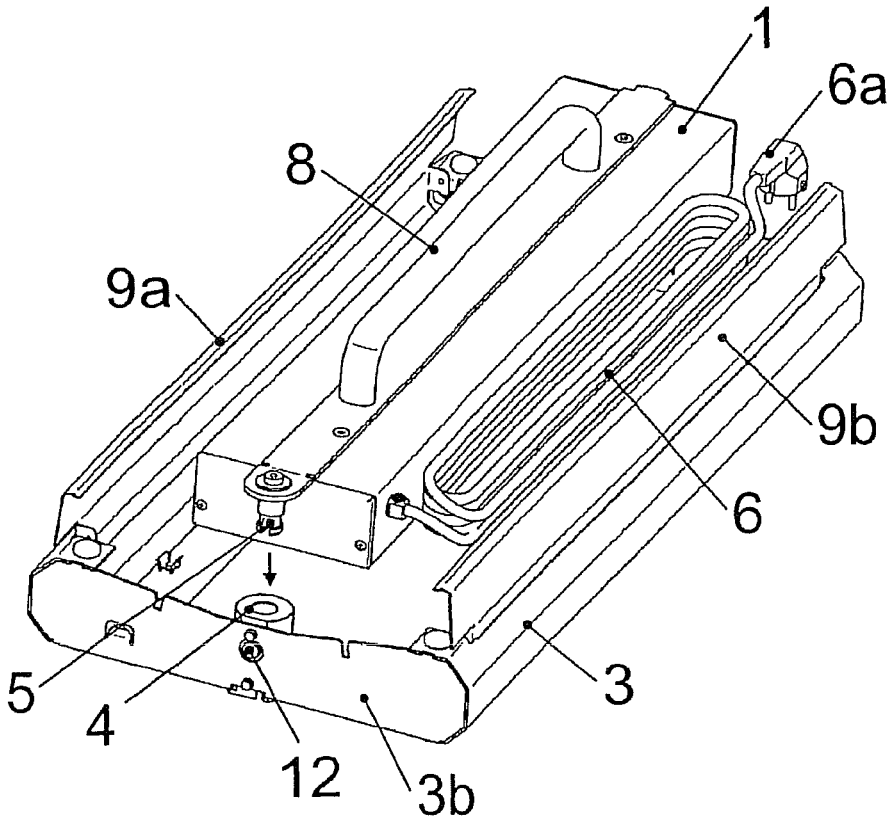
FIG. 4 shows a stand foot according to FIGS. 2 and 3 with the lamp head to be inserted.
Figure 5:
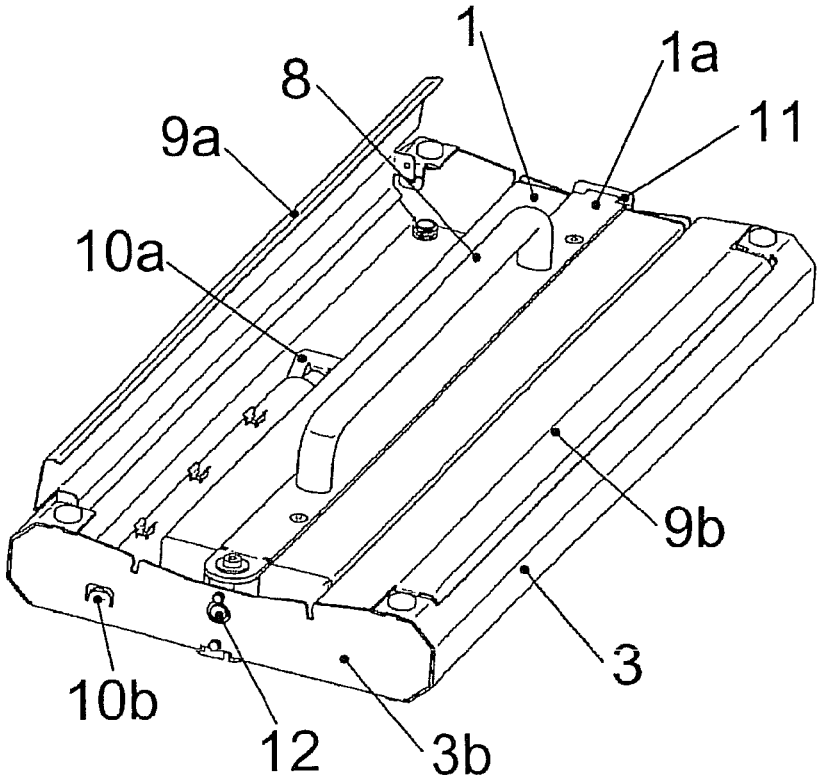
FIG. 5 shows the partially closed stand foot according to FIGS. 2 to 4 with inserted lamp head and upright tube.

The exemplary means for fastening the disassembled individual parts of the lamp inside lamp foot 3 forming the transport case are explained using FIGS. 3 through 5, but may be of any suitable means without departing from the present invention.

As noted in FIGS. 1 and 6, in order to disassemble the lamp, at first lamp head 1 fixed by pin 5 on upright tube 2 is withdrawn. Then, in order to disassemble upright tube 2 locked in a bayonet manner by pin 2*a* and sleeve 4 it is rotated counterclockwise and withdrawn from sleeve 4.

Figure 2:
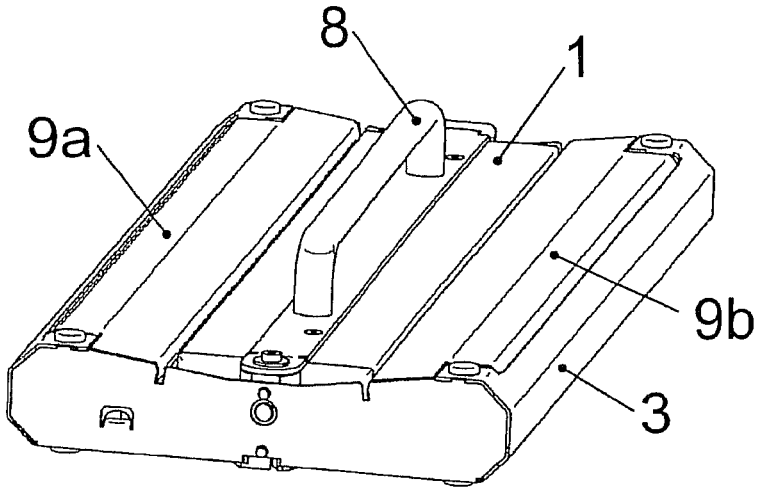
FIG. 2 shows a stand foot constructed as a transport case viewed from the bottom.

In order to stow lamp head 1 and upright tube 2 in stand foot 3 forming a transport case in accordance with FIG. 2, this stand foot is to be rotated into the position shown in FIGS. 3 to 5. FIG. 2 shows rotated stand foot 3 with open cover flaps 9*a* and *b*.

The compartment for receiving disassembled upright tube 2 is located below cover flap 9*a*. In order to fix this flap on the one hand a resilient clamp 10*a* into which upright tube 2 can be inserted with its lower pin 21 and on the side wall 3*b* a resilient tongue 10*b* which engages in the pin receptacle 2*b* are provided inside stand foot 3. This fixes upright tube 2 securely but in a simple and detachable manner in stand foot 3. Lamp head 1 is inserted, as FIG. 4 illustrates, in the area between the two flaps 9*a* and 9*b* in such a manner, as FIG. 2 shows, that handle 8 for purposes of transportation projects over the top of stand foot 3 serving as a transport case.

The fixing of lamp head 1 takes place on the one hand with the aid of pin 5, that that can be resiliently inserted into sleeve 4 associated with it. In order to secure the position a locking bolt 12 extending through side wall 3*b* is provided that secures pin 5 and therewith lamp head 1 in its position. On the opposite side lamp head 1 is fixed by a catch tongue 11 provided on side wall 3*a*, which tongue surrounds a catch nose located on lamp head 1 with its catch opening. The connection between the catch tongue and lamp head 1 can be loosened by deflecting catch tongue 11.

As FIG. 4 furthermore illustrates, wound-up mains cable 6 with its plug 6*a* finds room in the compartment under flap 3*b* adjacent to lamp head 1.

The inner space of stand foot 3 is closed by pivoting flaps 9*a* and 9*b*, so that stand foot 3 now forms a transport cage that is easy to manage and carry by handle 8.

Corks 13 and 14 preferably consisting of elastic or elastomeric material are provided on the top and the bottom of stand foot 3 that serve for the secure and protective support of stand foot 3 in the positions shown in FIGS. 1 and 2.

The following work steps are to be performed for setting up the lamp in the inverse sequence:

a) Open cover flaps 9*a* and 9*b*.
b) Pivot catch tongue 11 away for loosening the catch on the one side of lamp head 1 and pressing in the locking bolt 12 for unlocking lamp head 1 on the other side.
c) Remove upright tube 2 from resilient clamp 10*a* and from resilient tongue 10*b*.
d) Close cover flaps 9*a* and 9*b*.
e) Rotate stand foot 3 into the position shown in FIG. 1.
f) Insert upright tube 2 into sleeve 4 and rotate it clockwise through 30 degrees. Upright tube 2 is locked in the correct position in this position by the bayonet catch formed by pin 2*a* and sleeve 4.
g) Insert lamp head 1 with its pin 5 into pin receptacle 2*b* of upright tube 2.
h) Suspend mains cable 6 in cable holder 7. Then the lamp can be connected to plug 6*a* of the mains.

In as far as a stationary object is to be illuminated in mobile use only by lamp head 1, the latter can be simply pulled off from upright tube 2 and manually used.

In the claims, means or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

The invention claimed is:

1. A lamp, comprising:
a lamp head;
a base;
an upright tube;
said upright tube connecting the lamp head and the base, which latter are connected to one another in a releasable and latchable manner;
said base is operable as a case for receiving the lamp head with an associated mains cable and the upright tube;
said lamp head including compartments for receiving the disassembled base and the mains cable;
said compartments being provided on both sides of the lamp head; and
said compartments including operable cover flaps attached to the base.

2. The lamp, according to claim 1, wherein:
the lamp head is constructed as a mobile hand lamp and comprises a handle on its top.

3. The lamp, according to claim 1, wherein:
the lamp head and the upright tube further comprise:
a plurality of pins; and
said upright tube and the base further comprise:
pin receptacles releasably associated with the pins.

4. The lamp, according to claim 1, wherein:
a resilient clamp and a tongue are provided operably inside the base in order to fix the disassembled upright tube inside the base.

5. The lamp, according to claim 1, wherein:
in order to fix the disassembled lamp head inside the base a resilient catch tongue is arranged on a side wall of the base and a sleeve for receiving a pin provided on the lamp head is arranged opposite this catch tongue on another side wall of the base.

6. The lamp, according to claim 5, wherein:
a locking bolt is on the sleeve and extends through the side wall of the base.

7. The lamp, according to claim 1, wherein:
a plurality of elastomeric cork members are arranged on the top and the bottom of the base.

8. The lamp, according to claim 2, wherein:
the lamp head and the upright tube further comprise:
a plurality of pins; and
said upright tube and the base further comprise:
pin receptacles releasably associated with the pins.

9. A lamp, comprising:
a lamp head;
a base;
an upright tube;
said upright tube connecting the lamp head and the base, which latter are connected to one another in a releasable and latchable manner;
said base is operable as a case for receiving the lamp head with an associated mains cable and the upright tube;
said lamp head including compartments for receiving the disassembled base and the mains cable;
said compartments being provided on both sides of the lamp head;
said compartments including operable cover flaps attached to the base; and
the lamp head is constructed as a mobile hand lamp and comprises a handle on its top.

10. A lamp, comprising:
a lamp head;
a base;
an upright tube;
said upright tube connecting the lamp head and the base, which latter are connected to one another in a releasable and latchable manner;
said base is operable as a case for receiving the lamp head with an associated mains cable and the upright tube;
said lamp head including compartments for receiving the disassembled base and the mains cable;
said compartments being provided on both sides of the lamp head;
said compartments including operable cover flaps attached to the base;
the lamp head is constructed as a mobile hand lamp and comprises a handle on its top; and
a resilient clamp and a tongue are provided operably inside the base in order to fix the disassembled upright tube inside the base.

* * * * *

UNITED STATES PATENT AND TRADEMARK OFFICE

CERTIFICATE OF CORRECTION

PATENT NO. : 8,534,883 B2
APPLICATION NO. : 13/145383
DATED : September 17, 2013
INVENTOR(S) : Tomasi et al.

It is certified that error appears in the above-identified patent and that said Letters Patent is hereby corrected as shown below:

Title Page:

(30) Foreign Application Priority Data

Mar. 27, 2009 (DE)....."10 2209 014 706" should be changed to:

Mar. 27, 2009 (DE).....--10 2009 014 706.3--

Signed and Sealed this
Twenty-ninth Day of October, 2013

Teresa Stanek Rea

Teresa Stanek Rea
*Deputy Director of the United States Patent and Trademark Office*